US009550197B2

(12) United States Patent
Zimmer

(10) Patent No.: US 9,550,197 B2
(45) Date of Patent: Jan. 24, 2017

(54) DAMPENING UNIT COMPRISING A ROTATING BRUSH, AND CONTAINER-HANDLING MACHINE

(71) Applicant: KHS GmbH, Dortmund (DE)

(72) Inventor: Frank Zimmer, Darmstadt (DE)

(73) Assignee: KHS GmbH, Dortmund (DE)

( * ) Notice: Subject to any disclaimer, the term of this patent is extended or adjusted under 35 U.S.C. 154(b) by 61 days.

(21) Appl. No.: 14/384,751

(22) PCT Filed: Feb. 21, 2013

(86) PCT No.: PCT/EP2013/000494
§ 371 (c)(1),
(2) Date: Sep. 12, 2014

(87) PCT Pub. No.: WO2013/135341
PCT Pub. Date: Sep. 19, 2013

(65) Prior Publication Data

US 2015/0020733 A1 Jan. 22, 2015

(30) Foreign Application Priority Data

Mar. 14, 2012 (DE) ..... 10 2012 004 972

(51) Int. Cl.

| | |
|---|---|
| ***B05B 3/00*** | (2006.01) |
| ***B05B 7/16*** | (2006.01) |
| ***B05B 1/24*** | (2006.01) |
| ***B05B 3/10*** | (2006.01) |
| ***B41F 7/28*** | (2006.01) |
| ***B41F 7/30*** | (2006.01) |
| ***B41F 23/02*** | (2006.01) |
| ***B08B 3/10*** | (2006.01) |

(Continued)

(52) U.S. Cl.
CPC ..... *B05B 3/1007* (2013.01); *B05B 1/30* (2013.01); *B05B 9/002* (2013.01); *B08B 3/10* (2013.01); *B41F 7/28* (2013.01); *B41F 7/30* (2013.01); *B41F 23/02* (2013.01); *B41P 2235/23* (2013.01); *B41P 2235/26* (2013.01)

(58) Field of Classification Search
USPC ..... 118/300, 304, 256, 258–261, DIG. 16,118/321, 323, 302; 239/220, 121, 288, 222.11, 239/135; 162/205, 206, 361; 427/209; 15/88.2, 15/88.3, 302
See application file for complete search history.

(56) References Cited

U.S. PATENT DOCUMENTS 3,818,859 A * 6/1974 Kalmar ..... A23B 7/16 118/24
3,919,969 A * 11/1975 Leverett ..... A01C 1/08 118/13

(Continued)

FOREIGN PATENT DOCUMENTS

DE 1960863 6/1971
DE 2300651 7/1974

(Continued)

*Primary Examiner* — Yewebdar Tadesse
(74) *Attorney, Agent, or Firm* — Occhiuti & Rohlicek LLP

(57) ABSTRACT

A dampening unit that sprays viscous application liquid to a treatment surface includes a rotating brush driven to rotate around the axis, a liquid applicator that supplies the liquid to the brush, and a brush chamber to accommodate the brush. The brush chamber includes a wall that surrounds the brush. The wall defines an ejection window for discharging viscous application liquid that is either sprayed or spun away from the brush.

20 Claims, 10 Drawing Sheets

(51) Int. Cl.
*B05B 1/30* (2006.01)
*B05B 9/00* (2006.01)

(56) References Cited

U.S. PATENT DOCUMENTS

| | | | | |
|---|---|---|---|---|
| 4,143,596 | A | 3/1979 | Ivett | |
| 5,314,119 | A * | 5/1994 | Watt | B05B 3/08 101/363 |
| 5,642,790 | A * | 7/1997 | Kane | B60C 25/0596 118/232 |
| 6,520,294 | B2 * | 2/2003 | Delmoro | B29D 30/0633 184/20 |
| 2003/0086710 | A1 * | 5/2003 | Nozawa | G03D 3/132 396/612 |
| 2006/0225654 | A1 * | 10/2006 | Fink | C04B 30/02 118/723 R |

FOREIGN PATENT DOCUMENTS

| | | |
|---|---|---|
| DE | 7902905 | 5/1979 |
| DE | 3227213 | 1/1984 |
| DE | 19500967 | 7/1996 |
| DE | 19744546 | 4/1999 |
| DE | 10100211 | 7/2002 |
| DE | 102005036640 | 2/2007 |
| EP | 0518083 | 12/1992 |
| EP | 1593511 | 11/2005 |
| EP | 2328042 | 6/2011 |
| GB | 379475 | 9/1932 |

* cited by examiner

DAMPENING UNIT COMPRISING A ROTATING BRUSH, AND CONTAINER-HANDLING MACHINE

RELATED APPLICATIONS

Under 35 USC 371, this application is the national stage of PCT/EP2013/000494, filed on Feb. 21, 2013, which claims the benefit of the Mar. 14, 2012 priority date of German application 10 2012 004 972.2, the content of which is incorporated herein by reference.

FIELD OF INVENTION

The invention relates to a dampening unit, i.e. to a device for applying an application liquid to a treatment surface, and to a container handling machine that includes such a dampening unit.

BACKGROUND

Dampening units for applying treatment and/or application liquids to treatment surfaces in order to produce extensive, uniform, and generally very thin coatings from the respective application liquid are. Such dampening units are used, for example, in printing devices or printing machines for offset printing. In such machines, dampening unit is assigned to each of the printing cylinders to produce a color set of a multicolor print.

In one known printing device of this type, the dampening unit has a horizontally arranged brush that can be driven to rotate. The brush is provided with the application liquid and bears against an outer surface of the printing cylinder to transfer the liquid as the brush rotates about its brush axis.

Also known is a printing device comprising a plate cylinder or printing cylinder on which a multicolor printed image is produced via a plurality of color application rollers. Provided upstream of the color application rollers, in relation to the direction of rotation of the printing cylinder, is a horizontally arranged dampening unit for applying an application liquid to the printing cylinder. The dampening unit comprises a plurality of rollers that are driven to rotate. One of these rollers is an application roller that bears against the printing roller. A brush or brush roller that is driven to rotate applies the application liquid by spraying a layer on a further roller, which then transfers the application liquid to the application roller.

SUMMARY

The object of the invention is to provide a dampening unit by means of which a clean application even of small quantities of an application liquid to a treatment surface is possible in an inexpensive manner.

The dampening unit according to the invention is particularly suitable for applying thin, extensive, and very uniform coatings of treatment and/or application liquids, in particular for applying viscous or highly viscous treatment and/or application liquids, for example treatment and/or application liquids having a viscosity greater than 300 mPas, in small quantities. In an apparatus according to the invention, the application liquid is applied to the treatment surface by spraying in a contactless manner, without any contact between the treatment surface and the dampening unit, through an ejection window of a brush housing surrounding the brush or brush roller. The actual, i.e. effective, size of the ejection window determines the spray width and spray height with which the application liquid is applied. By suitably adjusting the effective size of the ejection window, the spray width and/or spray height can be adjusted.

One fundamental advantage of the dampening unit according to the invention lies in the fact that no pressure medium, such as compressed air, is needed, and therefore no generator for generating this pressure medium is required to apply or spray the application liquid. The dampening unit according to the invention is further characterized by a low degree of wear on its components.

In one preferred embodiment of the invention, the treatment surface is an outer surface of a container on which a coating is to be produced by the application liquid. Examples of coatings include a wet coating or a base layer or separating layer for an imprint forming the container label in connection with a direct print.

In principle, however, the dampening unit according to the invention is also suitable for other uses. For example, the dampening unit finds use in applying treatment or application liquids to surfaces of products to be printed, and to printing and/or plate cylinders of printing machines or printing units. When made portable design with an adapted supply system, the dampening unit can be used in a a system for example for applying wall paint or paints and lacquers or plastering agents. In a hygiene-optimized design, the dampening unit can also be uses as a spray apparatus for spraying, for example glazes or granular decorating agents, in a factory producing foodstuffs. It also possible to use the dampening unit in a system for spraying cleaning solutions, soaps, or the like for cleaning, for example, motor vehicles or airplanes. Another application of the inventive apparatus lies in its use as a a lubricant or coolant spraying device, for example (but not exclusively) for rolling mill applications.

In one aspect, the invention features an apparatus that includes a dampening unit that sprays viscous application liquid onto a treatment surface. Such a dampening unit includes a rotating brush driven to rotate around the axis, a liquid applicator that supplies the liquid to the brush, and a brush chamber to accommodate the brush. The brush chamber includes a wall that surrounds the brush. The wall defines an ejection window for discharging viscous application liquid that is either sprayed or spun away from the brush.

In another aspect, the invention features an apparatus having a dampening unit that sprays viscous application liquid onto a treatment surface. The dampening unit comprises a brush, a liquid applicator, and a brush chamber. The brush is driven to rotate around a dampening unit axis. The liquid applicator supplies the viscous application liquid to the brush. The brush chamber, which accommodates the brush, has a wall that surrounds the brush and that defines an ejection window for discharging viscous application liquid that is either sprayed or spun away from the brush.

In some embodiments, the brush has a brush body with a liquid path formed therein. This liquid path distributes the viscous application liquid on a circumference of the brush body. Among these embodiments are those in which the liquid path is formed at least partially by a distributor channel and by individual channels that are open on the circumference of the brush body and that open into a distributor channel.

In another embodiment, the invention includes means for applying the liquid to the brush from outside. Among these embodiments are those in which external nozzles deliver said viscous application liquid to a rubbing and wetting place for said brush.

Additional embodiments include either a stripping or striking element that cooperates with bristles of the brush and a stripping or striking edge formed by the element. Among these are embodiments in which the element is adjustable between first and second positions that can be changed relative to a brush axis. Among these are embodiments in which the element is adjustable by linear translation, and embodiments in which the element is adjustable by pivoting.

Some embodiments include a collecting beaker for collecting the viscous application liquid from at least one of the brush and the brush chamber. Among these are embodiments in which the collecting beaker is movable along an axis of the brush and relative to the brush. In these embodiments, the collecting beaker is movable relative to the brush chamber between a first position and a second position. In the first position, the collecting beaker is at a distance from the brush and the brush chamber, while in the second position, the brush is accommodated in the collecting beaker or substantially within the collecting beaker. Some of these embodiments also include a pump for conveying the viscous application liquid out of the collecting beaker, and, in at least some cases, a filling level sensor for controlling the pump.

Additional embodiments have a heater for heating the viscous application liquid that is supplied to the brush.

Yet other embodiments have either guide lugs or flaps for shaping the emission area. The guide lugs and flaps in these embodiments are provided on the ejection window.

In some embodiments, the ejection window has either an edge or a frame that comprises a coating to prevent adhesion or caking of the viscous application liquid.

Also included are embodiments that have means for shaping the emission area, with the means for shaping the emission area including a coating to prevent adhesion or caking of the viscous application liquid.

Additional embodiments include those in which the ejection window has an edge. In these embodiments, the edge is either a single-use frame or a disposable frame.

In another aspect, the invention features a container-handling machine comprising a rotating transport element and a plurality of container-handling stations disposed thereon. Each container-handling station is associated with any one of the dampening unit recited above. Among these embodiments are those that have a central fluid tank and a distribution system for conveying fluid from the central fluid tank to each of the dampening units.

As used herein, "containers" includes cans, bottles, tubes or pouches, in each case made from metal, paper/pulp, glass and/or plastic, as well as other packaging means that are suitable for being filled with products, for example with liquid or viscous products.

As used herein, "substantially" or "approximately" means deviations of ±10%, and preferably ±5%, from the exact value in each case, and/or deviations that do not affect the relevant function.

Further developments, advantages and possible uses of the invention will become apparent from the following description of examples of embodiments and from the figures. All the features described and/or shown in the figures, or in any combination, form in principle the subject matter of the invention, regardless of the way in which they are combined or refer back to one another in the claims. The content of the claims also forms part of the description.

BRIEF DESCRIPTION OF THE DRAWINGS

The invention will be explained in more detail below with reference an exemplary embodiment and to the figures, in which.

DETAILED DESCRIPTION

Figure 1:
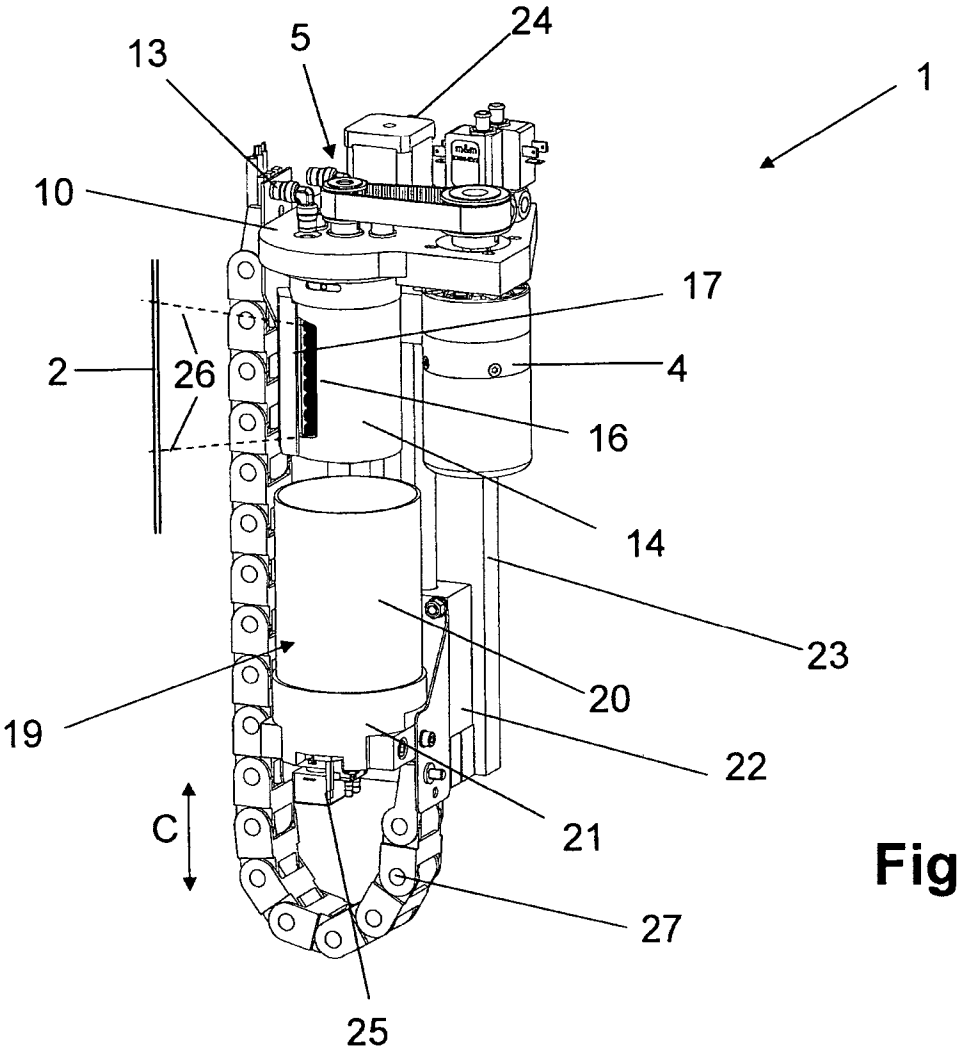
FIG. 1 shows, in a perspective view, a dampening unit (fluid spraying system) according to the invention.
Figure 2:
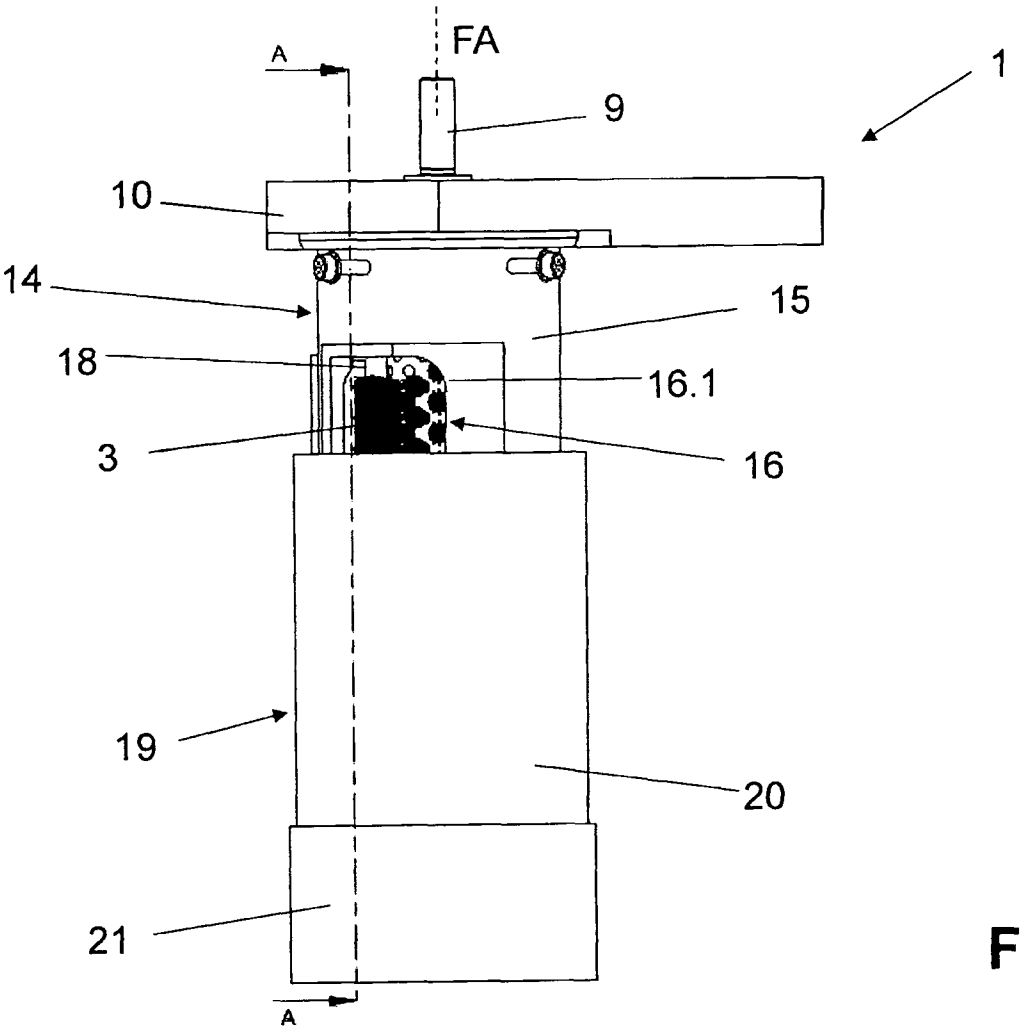
FIG. 2 shows the dampening unit of FIG. 1 in side view.

Referring to FIG. 1, a dampening unit 1 serves for applying viscous application liquids, without the use of pressure, to a treatment surface 2 of a product to be treated. The treatment surface 2 is typically a layer having a uniform surface distribution and having a uniform and small thickness, for example having a thickness in the millimeter range or less.

In the illustrated embodiment, the dampening unit 1 comprises a brush roller or brush 3 that is mounted such as to be able to be driven to rotate (arrow B) about a vertical axis FA thereof by an electric drive motor 4 via a belt drive 5 and via which, in the manner described in more detail below, the application liquid is applied to the treatment surface 2 by being spun off or sprayed. The dampening unit 1 is particularly suitable for spraying or applying application liquids having viscosities greater than 300 mPas.

In detail, the brush 3 includes a roller-like brush body 6 having a circular-cylindrical circumferential surface and a bristle region 7 consisting of a large number of bristles projecting radially away from the circumferential surface of the brush body 6. The bristles form tufts 8, each of which has a large number of bristles.

At the upper end, as shown in the figures, the brush body 6 is connected to a shaft 9 that is arranged coaxial with the axis of the brush body 6 and also coaxial with the axis FA, and by which the brush 3 is mounted in an upper, plate-like bearing element 10 by ball bearings 11, in a manner such as to be able to rotate about the axis FA. The axis is the vertical axis during operation of the dampening unit 1. Also attached to the bearing element 10 is the motor 4, the shaft of which, as well as the shaft 9, protrude beyond the top of the bearing element 10 facing away from the brush 3 and are connected to one another there via the belt drive 5. In a manner that is not shown, but is likewise suitable, the brush 3 can be rotated directly via a servomotor or a comparable drive.

In the illustrated variant, the shaft 9 is designed as a hollow shaft with a fluid channel 9.1 that continues into a fluid or distributor channel 6.1 in the brush body 6. The two channels 9.1 and 6.1 are arranged coaxial with the axis FA.

Individual channels 12 open into the distributor channel 6.1. The channels 12 are each oriented with their longitudinal extent radial or substantially radial to the axis FA and may also serve to hold the tufts 8 so that each individual channel 12 opens within a tuft of bristles 8 on the circumference of the brush body 6. When using media of higher viscosity, discharge channels may also be provided between the bristles. Via a rotary connection formed in the bearing element 10, the channel 9.1 is connected to an external connection 13 for supplying the liquid medium. In this case, a rotary passage or rotary connection is attached as an additional element to the shaft 9 or the shaft 9 is connected thereto.

One variant, which is technically simpler, provides for introducing the application fluid through the bearing element 10 via bores that are designed as nozzles. As a result, the application fluid is sprayed onto the brush 3 from above.

One special feature of the dampening unit 1 lies in the fact that the rotating brush 3 is accommodated in a brush housing 14 that, in the illustrated embodiment is a cylinder having a circular cross-section and that is formed substantially by a wall 15 and that is arranged with its axis coaxial to the axis FA. In the region of its upper edge, the wall 15 is attached to the underside of the bearing element 10 facing towards the brush 3. As also shown in particular in FIGS. 4-6, the wall 15 surrounds the rotating brush 3 such that the ends of the bristles of the bristle region 7 or of the tufts of bristles 8 are at a distance from the inner surface of the wall 15.

The wall 15 is provided with an ejection window 16. In the illustrated embodiment, the ejection window 16 is an elongate opening oriented with its longitudinal extent in the direction of the axis FA and that extends almost from the upper to the lower edge of the sleeve-like brush chamber 14. Provided at the ejection window 16 is a holder 17 for a stripping or striking element 18. In the embodiment shown in FIGS. 1-6, the element 18 is formed by a stripping or striking plate and is oriented with its surface sides parallel or substantially parallel to the axis FA. The element 18, which in the mounted state is located at an edge region of the ejection window 16, extends so far through the window into the brush chamber 14 that, as the brush 3 rotates, the bristles of the bristle region 7 run with their free end against the element 18, 18*a-d*, flex away from the latter under elastic deformation, and then spring back into their original position.

Figure 5:
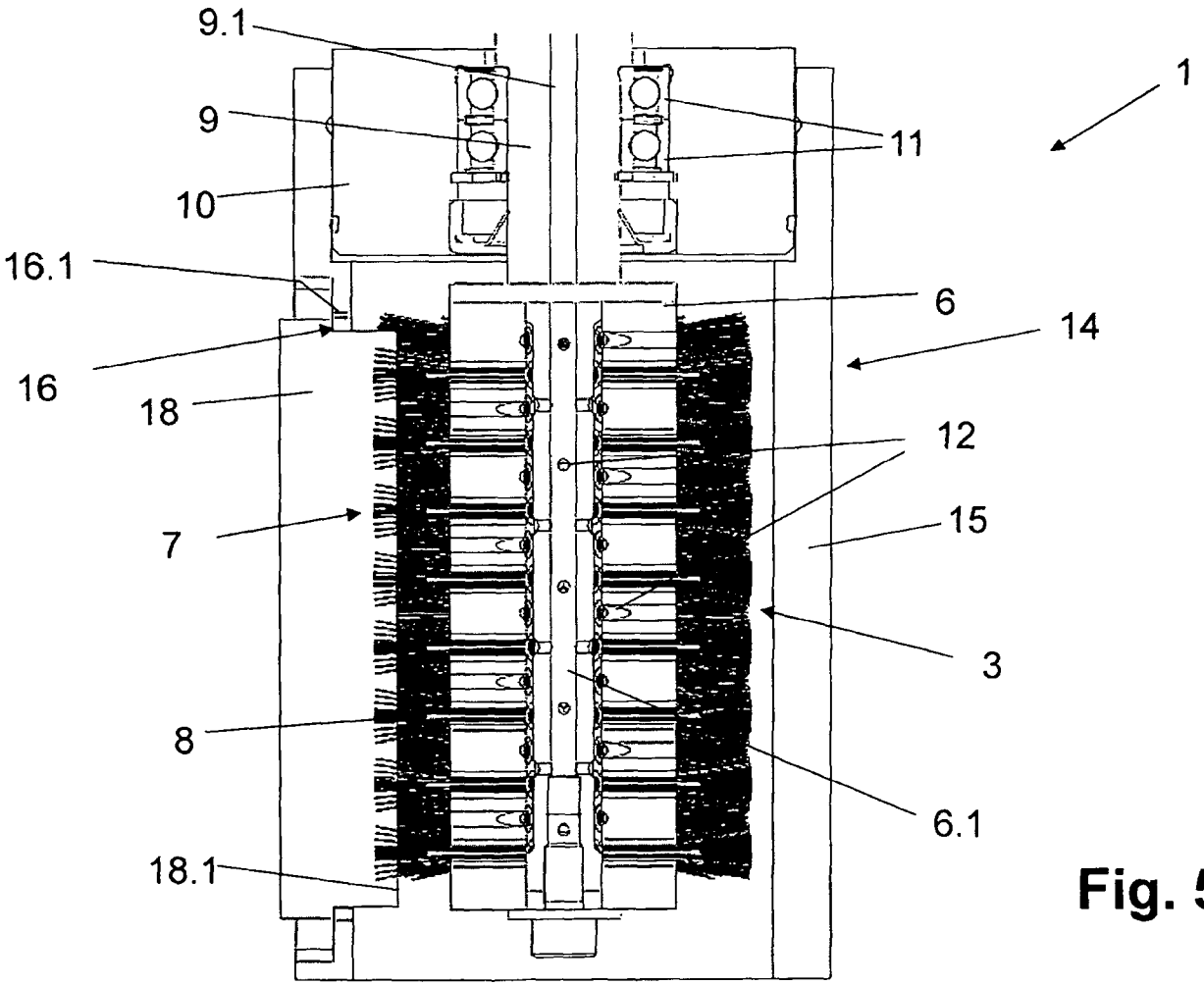
FIG. 5 shows, in an enlarged view, the rotating brush and the mounting thereof, together with the brush chamber surrounding the brush.
Figure 6:
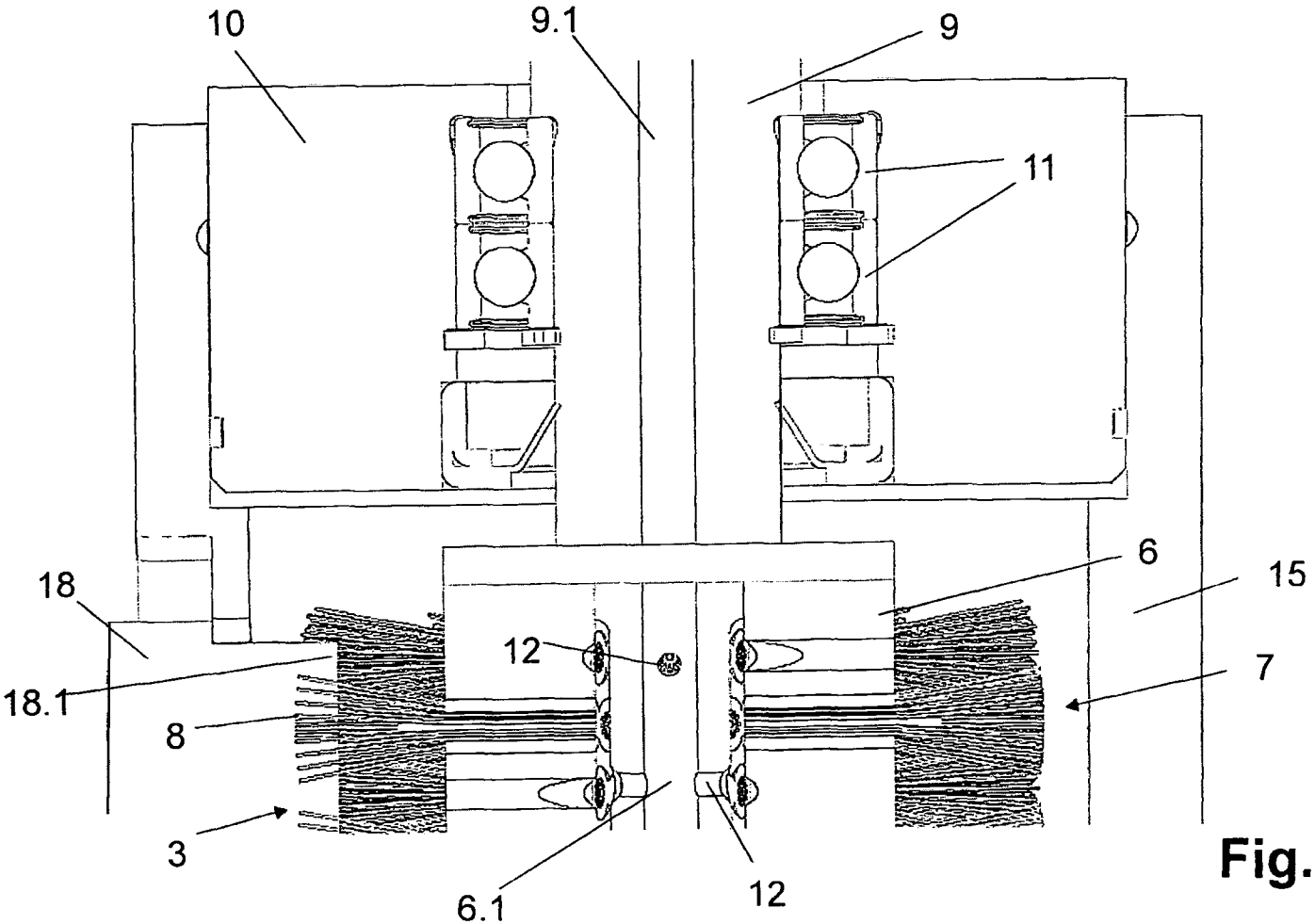
FIG. 6 shows, in an enlarged partial view, the brush and the mounting thereof.

In the embodiment shown in FIGS. 5 and 6, the edge 18.1 of the stripping element 18 which cooperates with the bristle region 7 is straight and is oriented parallel to the axis FA. In principle, other designs and orientations of the edge are also possible. In any case, however, the arrangement is such that the region of the stripping element 18 that cooperates with the bristle region 7 is located at that edge region of the ejection window 16 at which each bristle of the rotating brush 3 first moves into the region of the ejection window 16.

The dampening unit 1 further comprises a collecting beaker 19 that has a closed circumferential wall 20. In the illustrated embodiment, the wall 20 defines a cylinder having a circular cross-section and a base. With its circumferential wall 20, the collecting beaker 19 is likewise arranged concentric to the axis FA. The collecting beaker 19 is movable in the direction of the axis FA (double-headed arrow C), namely between a lower end position, shown in FIG. 1, in which the collecting beaker 19 is located with its top opening facing towards the rotating brush 3 and at a distance below the lower open end of the brush chamber 14, and an upper end position, in which the brush chamber 14 is completely accommodated in the collecting beaker 19. To this end, the collecting beaker 19 has, radial to the axis FA, an internal diameter that is greater than the corresponding external diameter of the brush chamber 14. The collecting beaker 19 also has an axial length, i.e. a length in the direction of the axis FA, that is at least equal to the corresponding axial length of the brush chamber 14.

For the adjusting or stroke movement, shown by the double-headed arrow C, the collecting beaker 19 is attached to a carriage 22 that, in turn, is guided in a carriage guide on a mounting frame 23 of the dampening unit 1 such as to be displaceable in the direction of the axis FA. A control drive 24 adjusts the carriage 2 and the collecting beaker 19. The control drive 24 is designed as a linear drive and is likewise provided on the mounting frame 23. The bearing element 10 is also attached to the mounting frame 23.

Figure 4:
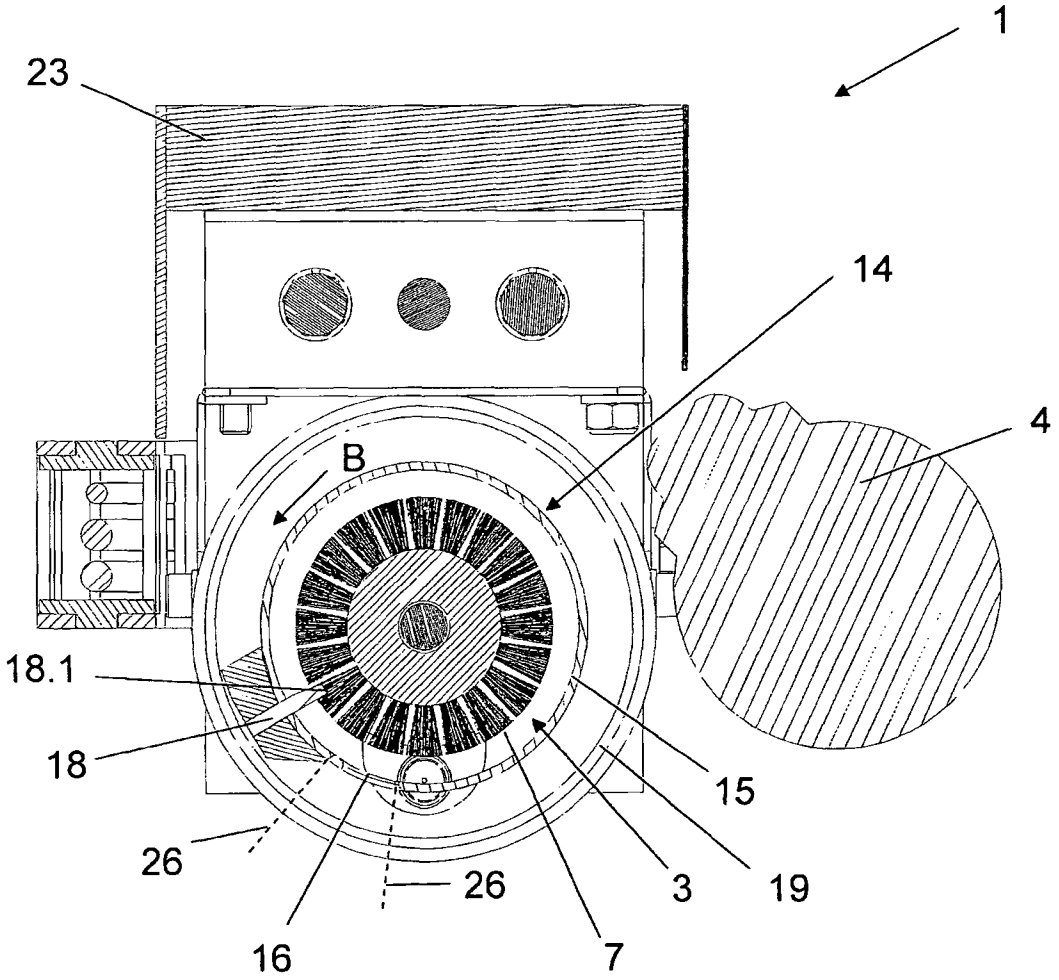
FIG. 4 shows a vertical section through the dampening unit of FIGS. 1-3.

Provided on the collecting beaker 19, which serves for collecting the application liquid flowing off or dripping from the brush 3, is a pump 25 that is controlled by a filling level sensor, shown in FIG. 4, in the interior of the collecting beaker 19, namely for conveying application liquid away in a controlled manner from the collecting beaker 19. The required electrical supply and control lines, and also the liquid line, which is in the form of a flexible hose, are accommodated in a chain element 27. For the purpose of cleaning the brush and the device, the collecting beaker 19 can be brought into a closed position with the head plate or the bearing element 10 so that a closed recycling and cleaning circuit can be set up.

In parallel with this, a suitable cleaning agent, in particular an alcoholic or water-based fluid, is circulated. In this case, the brush can also be driven in CIP mode.

Furthermore, the cleaned and non-loaded brush 3 can be loaded in a first step, while the collecting beaker 19 is still raised and the dampening unit 1 is still closed, in order to immediately bring about the desired fluid discharge performance.

Figure 3:
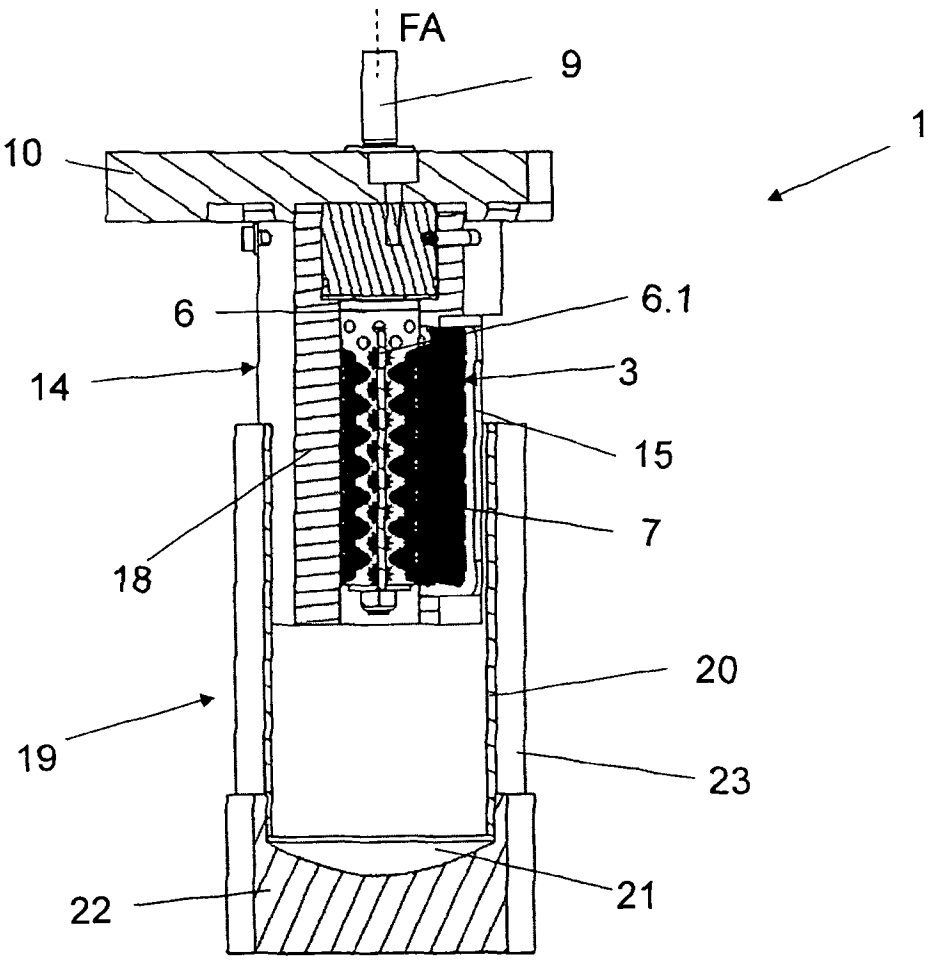
FIG. 3 shows a section along the line A-A in FIG. 2.

In a manner not shown in FIG. 3 but advantageously provided, the collecting beaker 19 has an outlet and is connected to a pump and/or directly to a reservoir and/or storage tank so that both overflowing application liquid and also the aforementioned cleaning agent can form a circuit.

The mode of operation of the dampening unit 1 can be described as follows:

In order to apply the application liquid to the treatment surface 2, in the illustrated variant the application liquid is supplied, while the brush 3 rotates, via the external connection 13 and via the channel 9.1 of the shaft 9 to the distributor channel 6.1 and then passes, in a manner distributed between the radial individual channels 12, to the tufts of bristles 8 so that the application liquid reaching the tufts of bristles is applied or sprayed in a finely distributed or atomized manner through the ejection window 16 onto the treatment surface 2 as a result of the centrifugal force or by spinning, and also due to the spring-back of the bristles of the bristle region 7 moving past the stripping element 18. In the process, the treatment surface 2 is moved past the ejection window 16 in an axial direction tangential or substantially tangential to the direction of rotation of the brush 3. Meanwhile, the collecting beaker 19 is positioned such that the brush chamber 14 extends at least with its lower, open end into the collecting beaker 19. The ejection or emission area 26, in which the atomized application liquid is applied, is defined by the size of the ejection window 16. By adjusting the collecting beaker 19 so that it covers the ejection window to a greater or lesser extent with its wall 20, the emission area 26 can be adjusted at least in the axial direction parallel to the axis FA.

Provided on the edge or frame 16.1 of the ejection window 16 are emission area shapers 26, examples of which include flaps, lugs, and/or slides. To prevent any adhesion or caking-on of the application liquid, the frame 16.1 and the emission area shapers 26 are provided with an anti-adhesion coating and/or the edge of the ejection window 16 is formed by a replaceable frame, for example a single-use or disposable frame 16.1. Fitting with a format part for an improved jet or spray mist distribution is also possible.

In addition to this normal mode for applying the application liquid to the treatment surface 2, the dampening unit 1 is also designed to be used during an automatic cleaning mode. In this mode, the collecting beaker 19 is moved into its upper end position so that it not only completely encloses the brush chamber 14 but also bears with its upper edge in a sealed manner against the underside of the bearing element 10. In this fully closed state, any residue of application liquid that is still present is pumped off from the collecting beaker 19 into a residue container. A suitable liquid cleaning medium, for example isopropanol, is then introduced into the collecting beaker 19 until the interior of the collecting beaker 19 is sufficiently filled, for example until it is 90% to 95% filled with this cleaning medium. Via control valves, the connection 13 is then connected to an output of the pump 25 so that, as the brush 3 rotates, the liquid cleaning medium is conveyed in a circuit from the collecting beaker 19 via the connection 13, the channel 9.1, the distributor channel 6.1 and the channels 12, thereby achieving intensive cleaning of the dampening unit 1. Because of the rotation of the brush 3, the cleaning is also mechanically assisted. Residues, particularly including any layers of application liquid on the inner surface of the brush chamber 14 and of the collecting beaker 19, are dissolved. Once the cleaning is finished, the cleaning fluid is pumped off into the residue container and the dampening unit 1 is opened for drying by lowering the collecting beaker 19.

It is possible to repeat the cleaning process at least one more time using a fresh liquid cleaning medium.

Figures 7, 8, 9, 10, 11, 12:
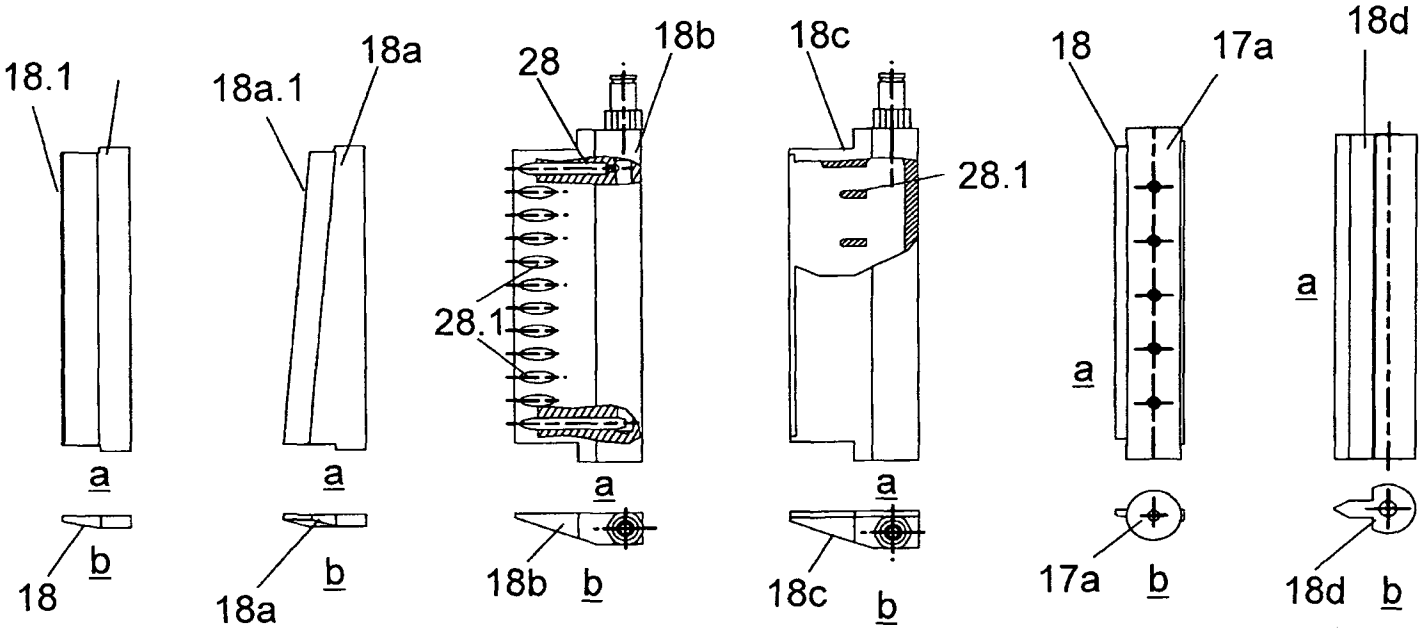
FIGS. 7-12 each show, in side view (position a) and in plan view (position b), different embodiments of a stripping plate or stripping edge.

FIG. 7 shows, in positions (a) and (b), once again the stripping element 18 designed as a stripping plate, shown in detail in side view and plan view, with the straight edge 18.1 towards which the thickness of the stripping element decreases. This edge may be chamfered or formed with a valley in order to create a more advantageous stripping angle or a local fluid reserve or run-off possibility.

FIG. 8 shows in positions (a) and (b), once again in side view and in plan view, a stripping element **18*a* that differs from the stripping element 18 substantially in that the edge 18*a*.1 corresponding to the edge 18.1 no longer runs parallel or substantially parallel to the axis FA when the stripping element 18*a* is mounted. Instead, it runs at an angle to the axis FA. The advantage of this design lies in the fact that more liquid is struck off in the lower stripping region since the tufts of bristles 8** arranged lower down are wetted to a greater extent by liquid running onto them from above. Due to this downwardly increasing degree of stripping, an overall uniform discharge performance can be ensured.

FIG. 9 shows in side view (position (a)) and in plan view (position (b)) a stripping element **18*b* that differs from the stripping element 18. In particular, in the stripping element 18*b*, the special holder 17 is not required for mounting the stripping element 18*b*, the stripping element 18*b* is adjustable by pivoting about an axis oriented for example parallel to the axis FA, and the stripping element 18*b* has, on its region that cooperates with the bristles of the bristle region 7, a plurality of exit openings 28.1 for the liquid application medium and for the cleaning fluid, to which the respective liquid medium is fed via liquid channels 28 formed in the stripping element 18*b*. The cross-section of the openings 28.1 and/or of the liquid channels 28** is set or selected according to the respectively desired fluid flow.

FIG. 10 likewise shows, in side view (position (a)) and in plan view (position (b)), a stripping element **18*c*, which corresponds to the stripping element 18*b* and likewise has openings 28.1** for applying the respective liquid medium, the openings being connected to internal liquid channels for supplying the medium.

FIG. 11 shows, in side view (position a)) and in plan view (position b)), the stripping element 18 together with a holder **17*a*. Unlike the holder 17, the holder 17*a* pivots about an axis, for example about an axis parallel to the axis FA, in order to adjust the position of the stripping element 18**.

Finally, FIG. 12 shows a stripping element **18*d* that does not require a holder for attaching it and that, once again, is pivotable about an axis, for example about an axis parallel to the axis FA, in order to adjust the region that cooperates with the bristles of the bristle region 7**.

The embodiments shown in FIGS. 7 to 12 can be combined as required. For example, the stripping element 18.1 of the type shown in FIG. 7 can also be designed as a fluid-carrying element and/or can also be mounted such as to be able to pivot about a vertical axis in order to be able to change the depth to which it penetrates into the brush chamber 14.

Figure 13:
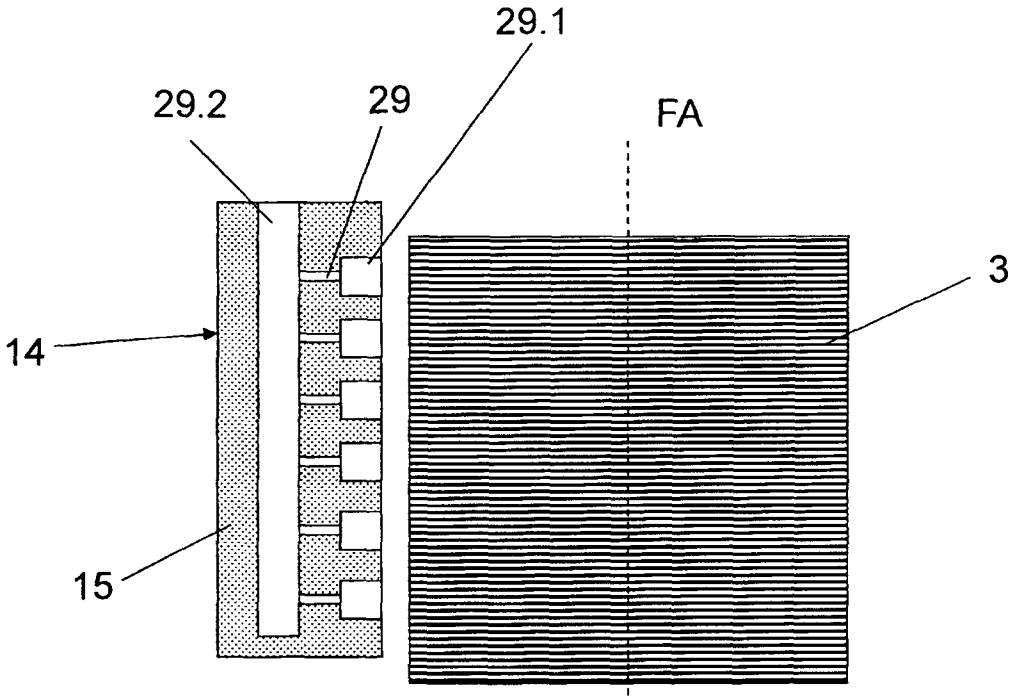
FIG. 13 shows, in a highly simplified view, the rotating brush and the brush chamber in a further embodiment of the invention.

FIG. 13 shows once again, in a view that is not to scale, the wall 15 of the brush housing 14. For applying the application liquid to the brush 3, there are provided, on the inner side of the wall 15, a plurality of nozzles 29, namely in each case within recesses 29.1, that are preferably designed so as to concentrically surround the axis FA in the manner of an annular groove. All the nozzles 29 are connected to distributor channels 29.1 for supplying the application liquid. The nozzles 29 collectively form a nozzle arrangement in which the nozzles 29 are provided in a plurality of rows which follow one another in the direction of the axis FA, wherein each row surrounding the axis FA in the manner of a partial ring comprises a plurality of nozzles 29. In one modification which is not shown, individual nozzles may also protrude, which pass through the wall 15 of the brush housing 14 with their nozzle body or are screwed into the wall 15 and which are connected to a common fluid line or to a plurality of fluid lines.

Figure 14:
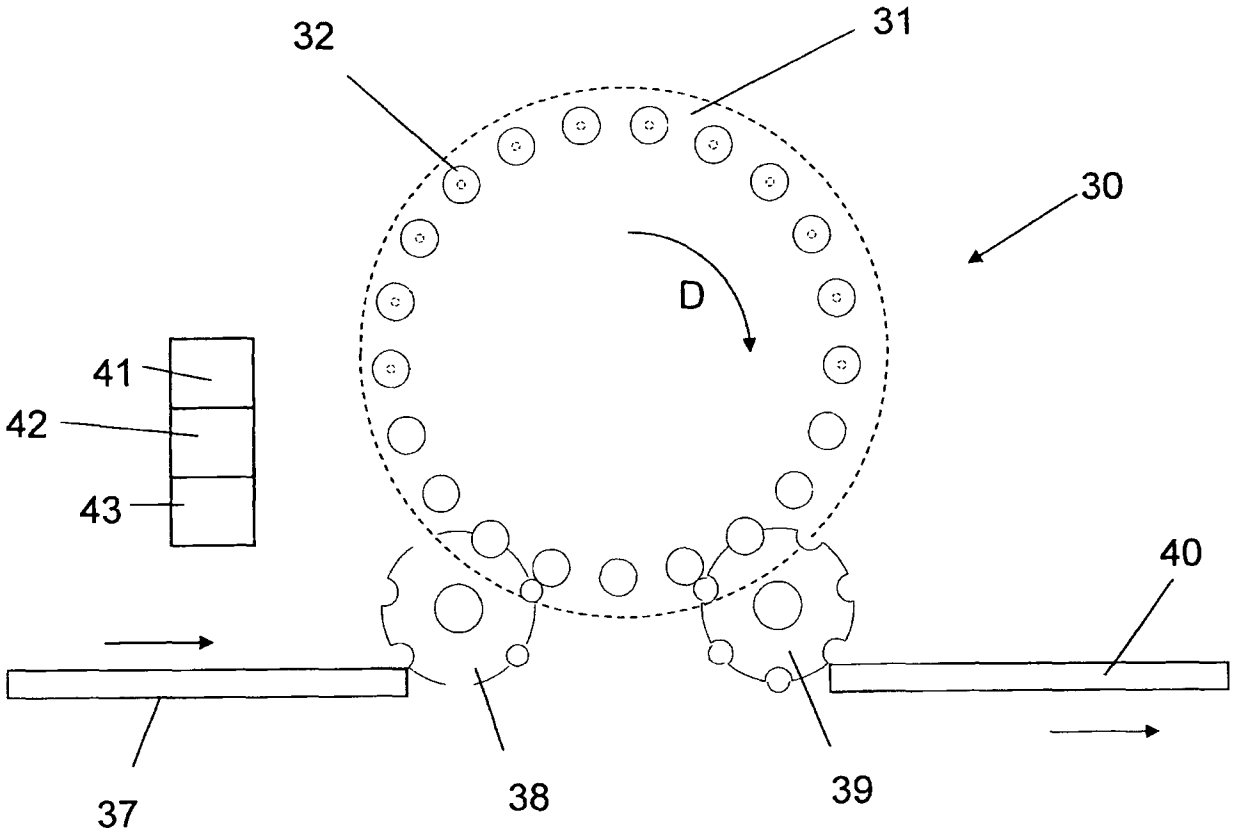
FIG. 14 shows, in a simplified plan view, a container handling machine for applying the treatment and/or application liquid to containers in order to coat the containers and/or in order to apply a base layer or separating layer to the containers.
Figure 15:
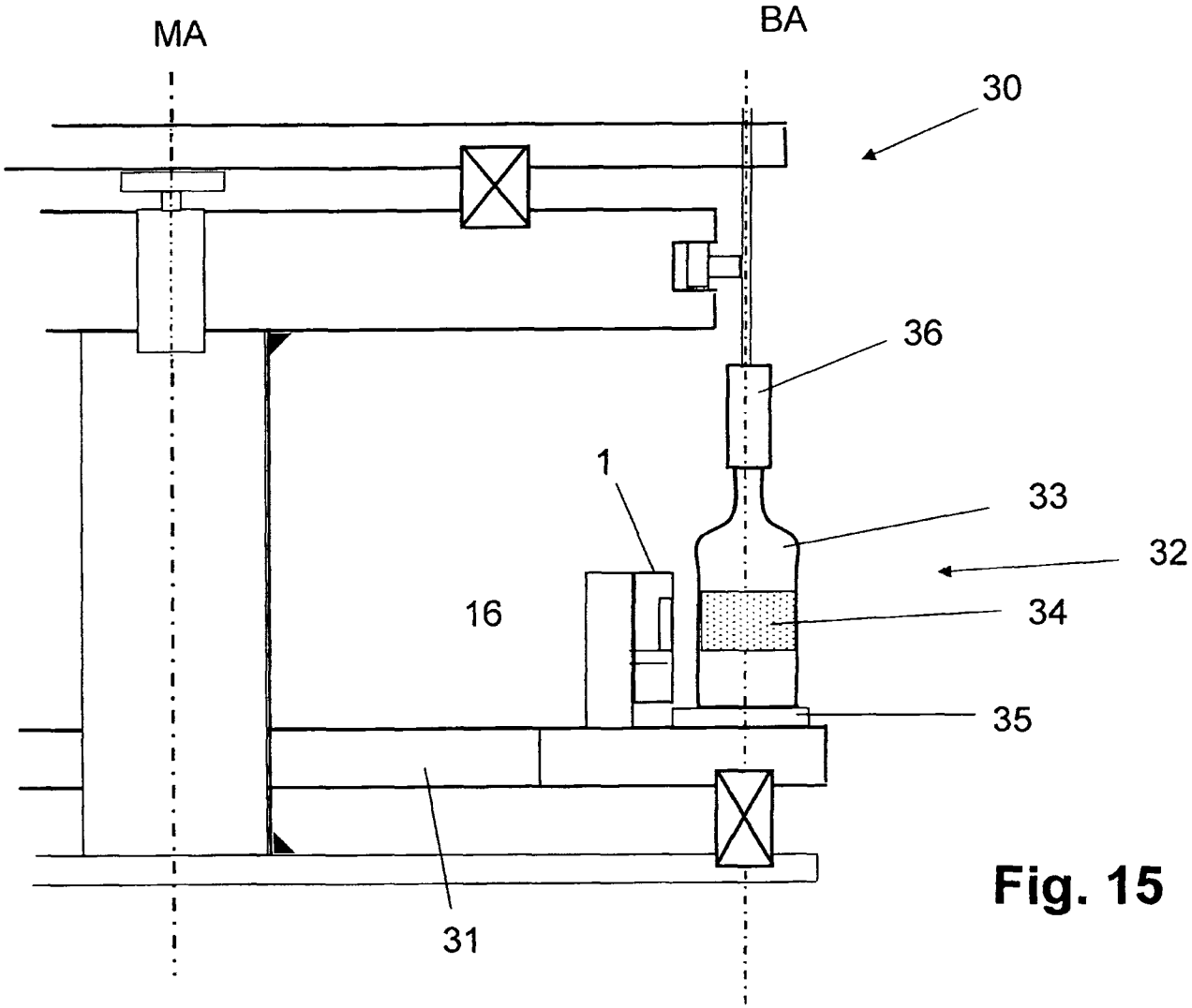
FIG. 15 shows, in a simplified detail view, one of the treatment positions of the container-handling machine of FIG. 14.

FIGS. 14 and 15 show a container handling machine 30 of the rotary type having a rotor 31 that can be driven in rotation about a vertical machine axis MA and on the circumference of which a plurality of treatment positions 32 are provided at which the containers 33 in the form of bottles are provided at least with a base layer or separating layer 34 on their container outer surface. To this end, each treatment position 32 has its own dampening unit 1, a container carrier 35, which in the illustrated embodiment includes a bottle plate and which is rotatable about a vertical container carrier axis BA and on which the bottles 32 stand with their base, and a plunger 36, which secures the containers 33 on the respective container carrier 35. The containers 33 are fed to the rotor 30 or to the treatment positions 32 via an external transporter 37 and a transport starwheel 38 serving as the container inlet so that in each case one container 33 is arranged at each treatment position 32. The treated containers 33 are forwarded to an external transporter 40 via a container outlet having a transport starwheel 39. In a variant that is not shown, the containers 33 are transferred directly to the next treatment device, for example a printing device or a drying and curing device.

In an alternative variant (not shown), the container 33 or object to be coated is stationary, i.e. is not rotated about its axis, and the dampening unit 1 moves around the container 33 or object. In such an embodiment, the fluid is supplied to the dampening unit 1 via suitable rotary distributors.

During the application of the application liquid, i.e. during the production of the base layer or separating layer, the container 33 provided at a treatment position 32 is rotated about its container axis BA by a drive that acts, for example, on the container carrier 35 so that the entire circumferential region of the container 33 that is to be provided with the base layer or separating layer 34 is moved past the dampening unit 1 or past the ejection window 16 oriented with its longitudinal extent parallel to the container axis. The width of the base layer or separating layer 34 in the direction of the container axis can be adjusted by raising and lowering the collecting beaker 19 of the dampening unit 1. All of the dampening units 1 are supplied with the application liquid from a common tank 41, to which the connections 13 of the dampening units 1 of all the treatment positions 32 are connected via connecting lines and at least one rotary connection or one rotary distributor. In an analogous manner, for cleaning the dampening units 1, a common tank 42 for the cleaning fluid and a common residue tank 43 for collecting residues of the application liquid and used cleaning fluid are present.

The application of the respective features to the base layer and separating layer 34 takes place in a further container handling machine (not shown) or else in the container handling machine 30, wherein then the individual treatment positions 32 also have a printing unit in addition to the dampening unit 1 or else at least one assembly that does not move with the rotor 31 and that is designed to apply the features to the containers 33 is provided on the movement path of the treatment positions 32 moving with the rotor 31.

The invention has been described above on the basis of examples of embodiments. It will be understood that numerous changes and modifications are possible without thereby departing from the inventive concept on which the invention is based.

For instance, it is possible that the the application liquid is supplied to the brush 3 with nozzles on a nozzle element or nozzle carrier against which the bristles of the rotating brush 3 run and that is designed, for example, as a rubbing and wetting plate for the brush 3.

Furthermore, means for heating the application liquid supplied to the brush 3 may be provided.

Having described the invention, and a preferred embodiment thereof, what is claimed as new and secured by Letters Patent is:

1. An apparatus comprising a dampening unit that sprays viscous application liquid to a treatment surface, wherein said dampening unit defines a vertical dampening unit axis and wherein said dampening unit comprises a brush, a liquid applicator, and a brush chamber, wherein said brush is driven to rotate around said vertical dampening unit axis, wherein said liquid applicator supplies said viscous application liquid to said brush, wherein said brush chamber accommodates said brush, wherein said brush chamber comprises a wall that surrounds said brush, wherein said wall defines an ejection window for discharging viscous application liquid that is one of sprayed and spun away from said brush.

2. The apparatus of claim 1, wherein said brush comprises a brush body, and a liquid path formed in said brush body, wherein said liquid path distributes said viscous application liquid on a circumference of said brush body.

3. The apparatus of claim 2, wherein said liquid path is formed at least partially by a distributor channel and by a plurality of individual channels that are open on said circumference of said brush body and that open into a distributor channel.

4. The apparatus of claim 1, further comprising means for applying said viscous application liquid to said brush from outside.

5. The apparatus of claim 4, wherein said means for applying said viscous application liquid to said brush comprises external nozzles that deliver said viscous application liquid to a rubbing and wetting place for said brush.

6. The apparatus of claim 1, further comprising an element and an edge, wherein said element forms said edge, wherein said element is selected from said group consisting of a stripping element and a striking element, wherein said edge is selected from said group consisting of a stripping edge and a striking edge, wherein said element cooperates with bristles of said brush.

7. The apparatus of claim 6, wherein said element is adjustable, wherein said edge of said element has a first position, wherein a region of said element that cooperates with said bristles has a second position, and wherein at least one of said first position and said second position can be changed relative to an axis of said brush.

8. The apparatus of claim 7, wherein said element is adjustable by linear translation.

9. The apparatus of claim 7, wherein said element is adjustable by pivoting.

10. The apparatus of claim 1, further comprising a collecting beaker for collecting said viscous application liquid from at least one of said brush and said brush chamber.

11. The apparatus of claim 10, wherein said collecting beaker is movable along an axis of said brush, wherein said collecting beaker is movable relative to said brush, wherein said collecting beaker is movable relative to said brush chamber between a first position and a second position, wherein, in said first position, said collecting beaker is at a distance from said brush and said brush chamber, and wherein, in said second position, said brush is accommodated in said collecting beaker.

12. The apparatus of claim 10, further comprising a pump for conveying said viscous application liquid out of said collecting beaker.

13. The apparatus of claim 12, further comprising a filling level sensor for controlling said pump.

14. The apparatus of claim 1, further comprising a heater for heating said viscous application liquid supplied to said brush.

15. The apparatus of claim 1, further comprising at least one of guide lugs and flaps for shaping said emission area, said at least one of guide lugs and flaps being provided on said ejection window.

16. The apparatus of claim 1, wherein said ejection window comprises at least one of an edge and a frame, wherein said at least one of an edge and a frame comprises a coating to prevent at least one of adhesion and caking of said viscous application liquid.

17. The apparatus of claim 1, further comprising means for shaping said emission area, wherein said means for shaping said emission area comprises a coating to prevent at least one of adhesion and caking of said viscous application liquid.

18. The apparatus of claim 1, wherein said ejection window comprises an edge, wherein said edge is one of a single-use frame and a disposable frame.

19. The apparatus of claim 1, further comprising a container handling machine comprising a rotating transport element and a plurality of container handling stations disposed thereon, wherein said dampening unit is one of a plurality of identical dampening units, each of which is associated with one of said container handling stations.

20. The apparatus of claim 19, further comprising a central fluid tank and a distribution system for conveying fluid from said central fluid tank to each of said dampening units.

* * * * *